US009426561B2

(12) United States Patent
Groh

(10) Patent No.: US 9,426,561 B2
(45) Date of Patent: Aug. 23, 2016

(54) MICROPHONE ARRANGEMENT WITH IMPROVED DIRECTIONAL CHARACTERISTIC

(71) Applicant: INSTITUT FUR RUNDFUNKTECHNIK GMBH, Munich (DE)

(72) Inventor: Jens Groh, Munich (DE)

(73) Assignee: Institut fur Rundfunktechnik GmbH, Munich (DE)

( * ) Notice: Subject to any disclaimer, the term of this patent is extended or adjusted under 35 U.S.C. 154(b) by 0 days.

(21) Appl. No.: 14/760,121

(22) PCT Filed: Jan. 10, 2014

(86) PCT No.: PCT/EP2014/050360

§ 371 (c)(1),
(2) Date: Jul. 9, 2015

(87) PCT Pub. No.: WO2014/108492

PCT Pub. Date: Jul. 17, 2014

(65) Prior Publication Data

US 2015/0358722 A1 Dec. 10, 2015

(30) Foreign Application Priority Data

Jan. 11, 2013 (IT) ..... TO2013A0028

(51) Int. Cl.
*H04R 1/32* (2006.01)
*H04R 1/40* (2006.01)
*H04R 3/00* (2006.01)

(52) U.S. Cl.
CPC ..... *H04R 1/326* (2013.01); *H04R 1/406* (2013.01); *H04R 3/005* (2013.01)

(58) Field of Classification Search
None
See application file for complete search history.

(56) References Cited

U.S. PATENT DOCUMENTS

2003/0072461 A1 4/2003 Moorer
2004/0076301 A1 4/2004 Algazi et al.

(Continued)

FOREIGN PATENT DOCUMENTS

WO 2011/057922 A1 5/2011
WO 2013/050575 A1 4/2013

OTHER PUBLICATIONS

International Search Report and Written Opinion dated Mar. 27, 2014, issued in PCT Application No. PCT/EP2014/050360, filed Jan. 10, 2014.

(Continued)

*Primary Examiner* — Paul Huber
(74) *Attorney, Agent, or Firm* — Workman Nydegger

(57) ABSTRACT

A microphone arrangement with improved directional characteristics is provided with at least two microphones (100, 102) and a signal processing arrangement (105). The signal processing arrangement is provided with a first (108) and a second input (109) for receiving the microphone signals of the at least two microphones. The inputs (108,109) are coupled to signal inputs of a first (110) and a second (111) multiplication circuit. The multiplication circuits are provided with control inputs for receiving respective first and second control signals, and with signal outputs. A control signal generator (112) is provided for generating the first and second control signals for the multiplication circuits (110, 111). An arrangement (114) for a power corrected summation is provided, having a first and a second input coupled to the outputs of the first and second multiplication circuit, respectively, and having an output. A signal combination circuit (116) is provided with a first input (117) coupled to the output of the power corrected summation arrangement (114), a second input (118) coupled to one of the at least two microphones (102), and an output (119) coupled to the output (120) of the combination circuit (116). The first multiplication circuit (110) is adapted to multiply the signal applied to its input by a multiplication factor $A*(1-g)^{1/2}$, under the influence of the first control signal. The second multiplication circuit (111) is adapted to multiply the signal applied to its input by a multiplication factor $B*g^{1/2}$ under the influence of the second control signal. The multiplication factor g is frequency dependent (g[f]), and A and B are constant values, whose absolute values are preferably equal to 1. Further, A=B or A=−B applies. Preferably, the multiplication factor g[f], below a first frequency value, has a smaller value for increasing frequencies. Below a second frequency value that is smaller than the first frequency value, g[f] is a constant value (V), preferably equal to zero. (FIG. 2*a*) Thereby, a microphone arrangement can be obtained which exhibits a desired directional characteristics over an increased frequency range.

18 Claims, 16 Drawing Sheets

(56) References Cited

U.S. PATENT DOCUMENTS

| | | | | |
|---|---|---|---|---|
| 2012/0013768 | A1 | 1/2012 | Zurek et al. | |
| 2013/0195297 | A1* | 8/2013 | Burns | H04R 3/005 381/313 |
| 2013/0279295 | A1* | 10/2013 | Calvarese | G01S 3/80 367/100 |

OTHER PUBLICATIONS

Osamu Hoshuyama et al., *A Robust Generalized Sidelobe Canceller with a Blocking Matrix Using Leaky Adaptive Filters*, Electronics and Communications in Japan, Part 3, vol. 80, No. 8, 1997, pp. 1516-1624.

* cited by examiner

MICROPHONE ARRANGEMENT WITH IMPROVED DIRECTIONAL CHARACTERISTIC

INTRODUCTION

The invention relates to a microphone arrangement comprising at least two microphones and a signal processing arrangement for deriving a virtual microphone signal from the microphone signals of the at least two microphones. The invention also relates to this signal processing arrangement. A microphone arrangement as defined in the preamble of claim 1, is known from the published US patent application US2004/0076301. The known microphone arrangement is intended to realise a binaural recording in such a way that a 3D audio playback for a listener is possible.

DESCRIPTION OF THE INVENTION

The present invention, however, is intended to propose a microphone arrangement, the directional characteristic of which can be modified as desired. One target could be, for example, to keep the directional characteristic constant over an increased frequency range.

To this end, the microphone arrangement of the invention is characterised by the features of claim 1. The signal processing arrangement of the invention is characterised as specified in claim 18.

The invention is motivated by existing arrangements composed of several microphones, the signals of which are combined (microphone arrays). They are normally intended to increase the directivity relative to one microphone. Directivity means that the sound recorded from a desired direction (main direction) is amplified, whilst the sound recorded from other directions is attenuated. There may be several desired directions if necessary. The directivity of such arrangements is based on the running time of the sound, which causes the direction-dependent phase differences between individual microphone signals. The combination of these signals is normally effected by summation (possibly weighted). But because the phase differences are also frequency-dependent, directivity in consequence becomes frequency-dependent which is a disadvantage, because this results in conventional microphone arrays ending up with only a narrow frequency range in which their directional characteristic is optimal. Outside this frequency range, directivity is worse, which is measurable as a reduced directivity index and which is reflected by the fact that outside the main direction the frequency response is not the same as in the main direction, in particular is not flat.

The invention introduces a technique by which initially virtual microphone signals are generated from the microphone signals and then the virtual microphone signals are mixed. The virtual microphone signals correspond to such signals as if they were coming from imaginary microphones if these were positioned outside the actual microphone positions. The virtual positions are interpolated or extrapolated from the actual microphone positions. In this way an effect is achieved as if the microphone array were becoming smaller (when interpolated) or becoming larger (when extrapolated). The interpolation or extrapolation of positions corresponds to an interpolation or extrapolation of microphone signals and is thus controllable. When generating virtual microphone signals, the interpolation or extrapolation is controlled, according to the invention, as a function of the frequency in order to make the virtual positions frequency-dependent. As a result the frequency dependency of the directivity of the microphone array can also be modified as desired, and the directional characteristic can be optimised across an increased frequency range, for example in such a way that it remains mostly constant.

SHORT DESCRIPTION OF THE FIGURES

The invention will now be described with the reference to the drawing by way of some exemplary embodiments, in which FIG. 1 shows a first embodiment of a microphone arrangement according to the invention, FIGS. 2*a*, 2*b* and 2*c* show three curves indicating the behaviour of the multiplication factor g[f] as a function of the frequency f, in the microphone arrangement of FIG. 1, FIGS. 3*a* and 3*b* show some directional characteristics of a known microphone arrangement of FIG. 1, FIG. 4 shows a second embodiment of a microphone arrangement according to the invention, FIGS. 5*a*, 5*b* and 5*c* show three curves indicating the behaviour of the multiplication factor g[f] as a function of the frequency f, in the microphone arrangement of FIG. 4, FIGS. 6*a* and 6*b* show some directional characteristics of a known microphone arrangement and a microphone arrangement of FIG. 4, FIG. 7 shows a third embodiment of a microphone arrangement according to the invention, FIG. 8 shows the position of the microphones of the microphone arrangement according to FIG. 7, FIG. 9 shows a fourth embodiment of a microphone arrangement according to the invention, and FIG. 10 shows the position of the microphones of the microphone arrangement according to FIG. 9.

Figure 1:
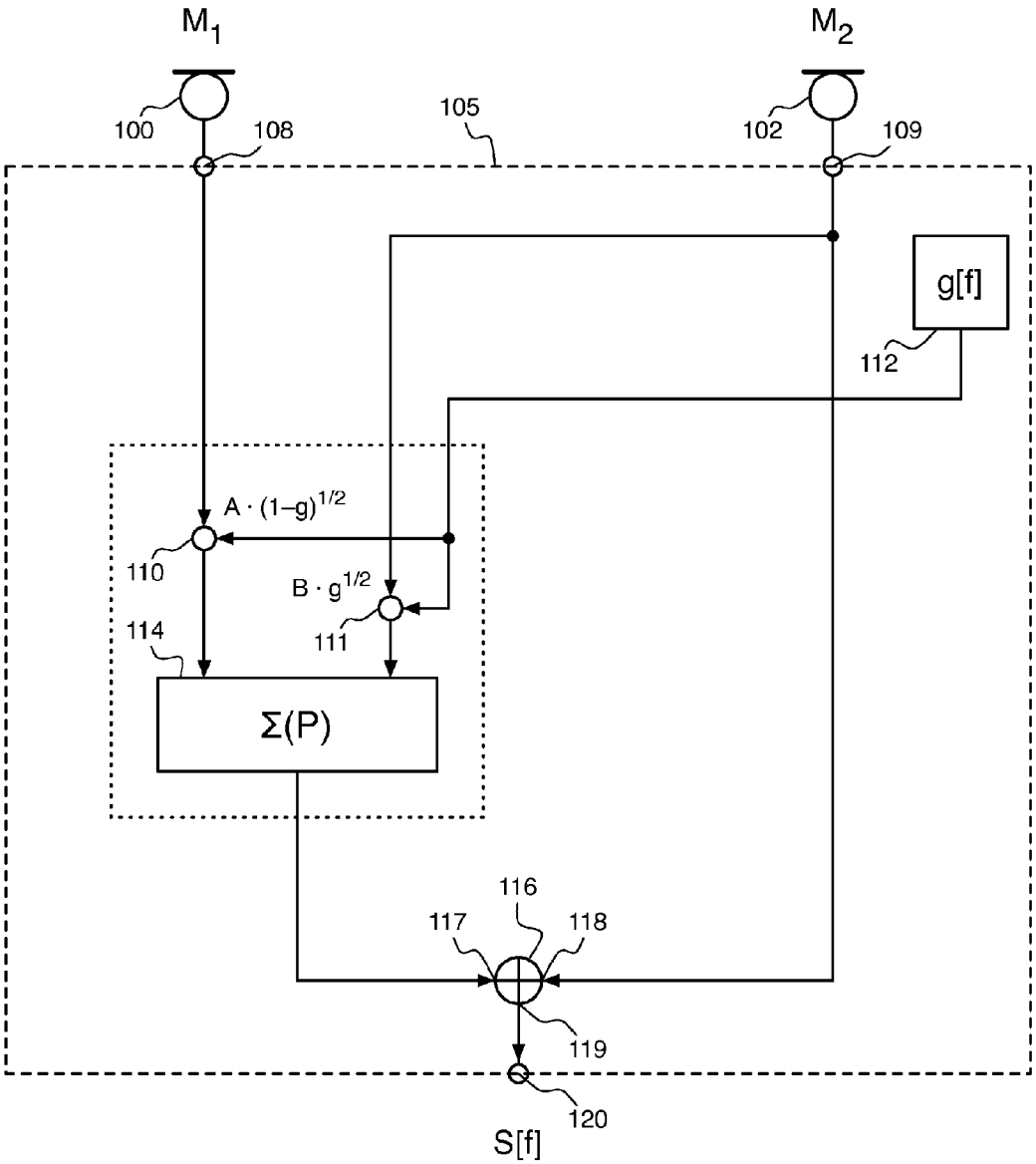
FIG. 1 shows a first embodiment of the microphone arrangement according to the invention. The microphone arrangement is provided with two microphones 100, 102 and a signal processing arrangement 105 for deriving a virtual microphone signal from the microphone signals of the two microphones 100 and 102. The signal processing arrangement 105 is provided with a first and a second input 108 and 109 for receiving the microphone signals of the two microphones 100 and 102, respectively. A first and a second multiplication circuit 110, 111 is provided with signal inputs coupled with the first and second inputs 108, 109 of the signal processing arrangement, respectively, with control inputs for receiving respective first and second control signals, respectively, and with signal outputs. The signal processing arrangement 105 further includes a control signal generator 112 for generating the first and second control signals. An arrangement 114 for power-corrected summation is provided, with a first and a second input coupled with the output of the first and second multiplication circuits 110, 111, respectively, and with an output. The arrangement 114 is configured for power-corrected summation of the signals offered at its first and second inputs and for providing a power-corrected summed overall signal to the output.

Power-corrected summation arrangements, as understood here, are known from the literature. In this respect reference should be made to the WO2011/057922A1 and the previously filed but not yet published PCT/EP2012/069799 of the same applicant, in particular to the description of FIGS. 2, 6 and 7, which are therefore regarded as being hereby incorporated by reference.

A signal combining arrangement 116 is provided, with a first input 117 coupled with the output of the power-corrected summation arrangement 114, a second input 118 coupled with one of the at least two microphones, in this case microphone 102, and with an output 119 coupled with the output 120 of the signal combining arrangement 116.

The first multiplication circuit 110 is configured for multiplying the signal at its input with a multiplication factor $A\cdot(1-g)^{1/2}$ under the influence of the first control signal of the control signal generator 112. The second multiplication circuit 111 is configured for multiplying the signal at its input with a multiplication factor $B\cdot g^{1/2}$ under the influence of the second control signal of the control signal generator 112. According to the invention, g is frequency-dependent and thus indicated as g[f], and A and B are constant values, the absolute values of which are preferably equal 1. Further, A=B or A=−B applies.

Figure 2A:
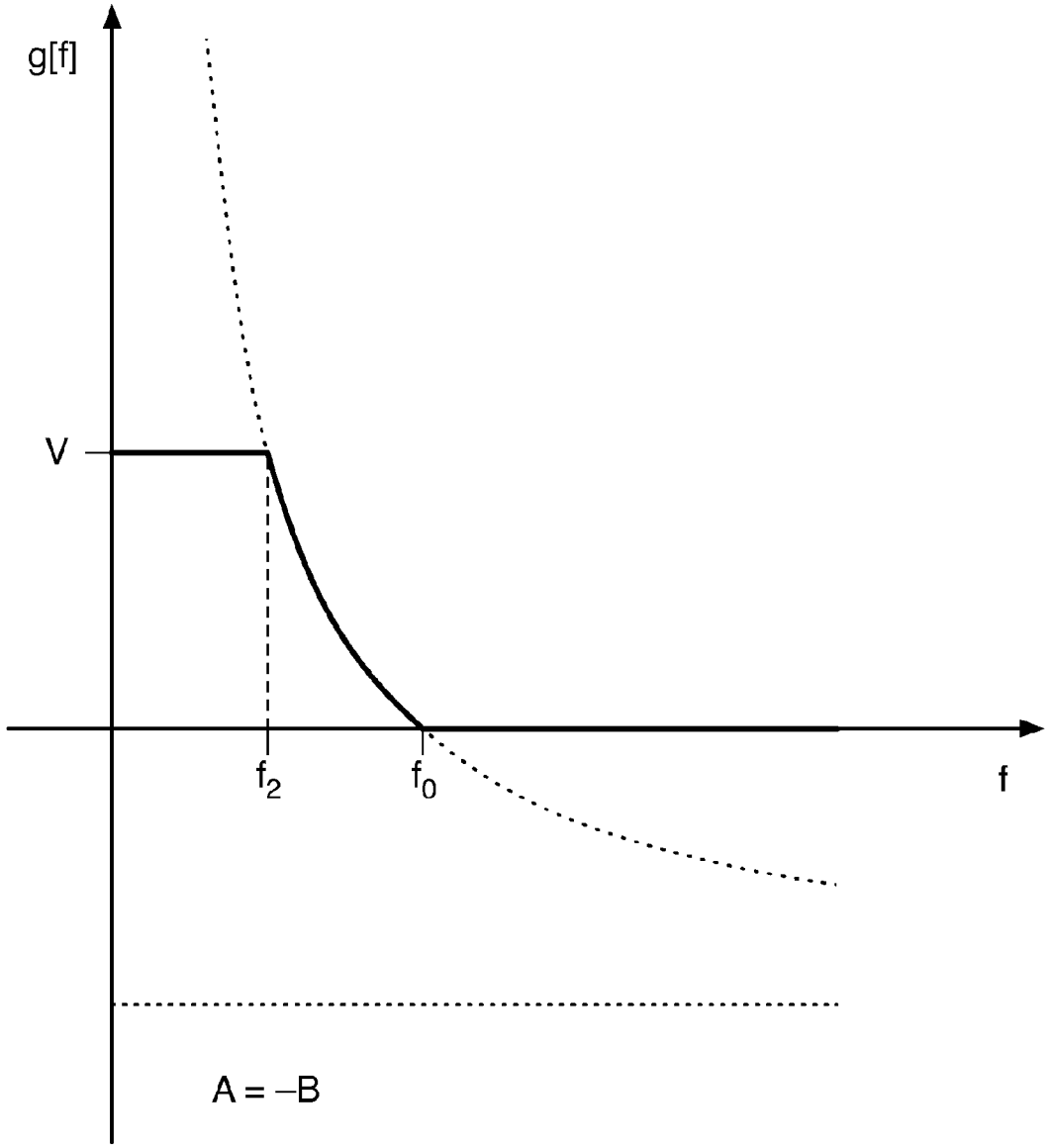

FIG. 2*a* shows, what the frequency-dependent behaviour of the multiplication factor g[f] might look like. In this embodiment, A=−B applies.

In FIG. 2*a*, the multiplication factor g[f] between a first frequency value $f_0$ and a second frequency value $f_0$ shows an increasingly diminishing value $f_2$ as the frequency increases. Below the frequency value $f_2$, g[f] is a constant value V, preferably equal 1. Above the first frequency value $f_0$, g[f] is constant in turn, preferably equal zero. In the frequency range between $f_2$ and $f_0$, g[f] decreases continuously as the frequency increases.

Figure 3A:
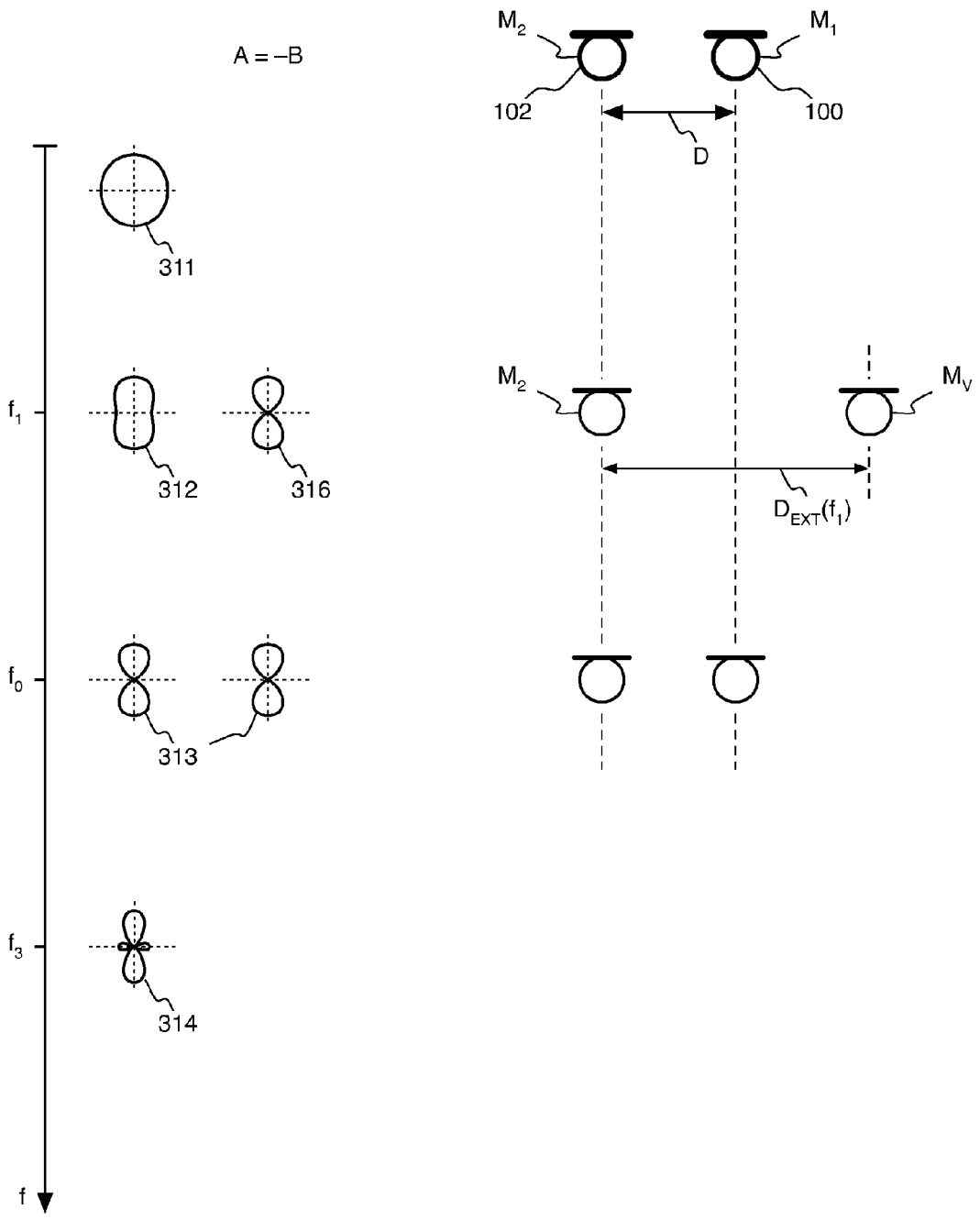

The mode of operation of the microphone arrangement as shown in FIG. 1 with the behaviour for g[f] as shown in FIG. 2*a* will now be explained in detail with reference to FIG. 3*a*. FIG. 3*a* shows the directional characteristics of a microphone arrangement with two microphones as shown in FIG. 1, which are arranged at a distance D from each other and the output signals of which are directly added together. For low frequencies the directional characteristic is as shown by 311, i.e., spherical. For increasing frequencies the directional characteristic changes as indicated by the directional characteristics 312, 313 and 314. Here the directional characteristic 313 is assumed to be the desired directional characteristic because the directivity of the microphone arrangement is at its highest. Directivity is defined as the ratio of sensitivity in a main direction versus mean sensitivity of the microphone arrangement in all directions. The spherical characteristic 311 is too sensitive for sound from directions outside the main directions, and the same applies to the directional characteristic 314. The frequency $f_0$, at which the optimal directional characteristic occurs, depends on the distance D, as follows:

$$f_o=C/(2\cdot D)$$

wherein C is the speed of sound.

It is the object of the invention to maintain this optimal directional characteristic 313 constant for an increased frequency range. This is achieved in the following way: Signal processing in the circuit parts 110, 111, and 114 leads to a virtual microphone signal of a virtual microphone Mv at the output of the device 114, which microphone is situated either between the two microphones 100 and 102 (whereby an interpolation of the microphone signals is performed by the circuit parts 110, 111 and 114) or outside the two microphones 100 and 102 (whereby an extrapolation of the microphone signals is performed by the circuit parts 110, 111 and 114). In consequence the virtual microphone signal of the virtual microphone (which is present at the output of the arrangement 114) and the microphone signal of the microphone 102 are combined in the signal combining arrangement 116 for deriving the output signal at the output 120. The distance between the virtual microphone and the microphone 102 is smaller for an interpolation than the distance between the microphones 100 and 102 and larger for an extrapolation.

An extrapolation in the signal processing arrangement 105 is achieved in case A=−B. For example A could be equal to 1. If we assume this, then this means for the signal processing arrangement 105 that the multiplication factor in the multiplication circuit 111 is equal to $-g^{1/2}$ and the multiplication factor in the multiplication circuit 110 is equal to $(1-g)^{1/2}$. Extrapolation means that the distance $D_{EXT}$ between the virtual microphone Mv and the microphone 102 is larger than D, and thus the frequency at which the optimal directional characteristic occurs is below $f_0$, e.g., occurs at $f_1$, as indicated by the directional characteristic 316 in FIG. 3*a*. Because of the frequency dependency of g[f], as indicated in FIG. 2*a*, this means that this optimal directional characteristic is largely maintained in a frequency range between $f_0$ and $f_2$ as indicated by the frequency characteristics 313 and 316 in FIG. 3*a*. Since g[f] is constant above $f_0$, preferably equal to zero, the directional characteristic of the microphone arrangement for frequencies above $f_0$ remains unchanged.

For $f<f_2$, g cannot increase beyond the value 1 because g=1 is the maximum possible value, for which $(1-g)^{1/2}$ can be calculated.

It should be mentioned that in the above description the correlation between $D_{EXT}$, depending on the frequency, and g[f] is as follows:

$$D_{EXT}(f)/D\approx 1+g[f] \text{ for } f_2<f<f_0$$

Further, $$f_0/f\approx D_{EXT}(f)/D$$

applies.

Figure 2B:
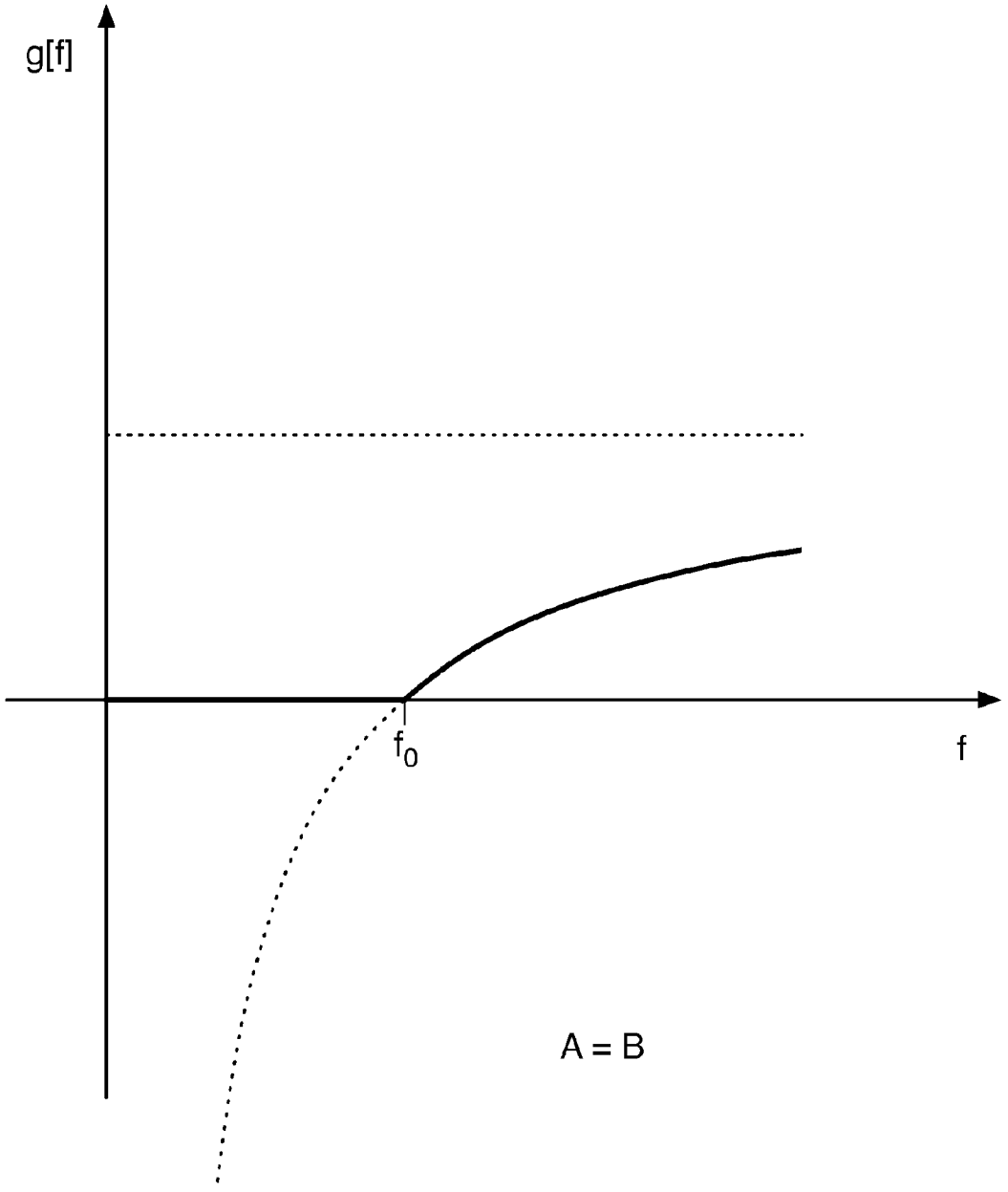

An interpolation in the signal processing arrangement 105 is achieved in case A=B, wherein the multiplication factor g[f] behaves as a function of the frequency, as indicated in FIG. 2*b*. For frequencies below $f_0$, g[f] is equal to a constant, preferably equal to zero. For frequencies above $f_0$, the multiplication factor g[f] increases in value as the frequency increases. Preferably, the multiplication factor g[f] continuously increases in value above $f_0$ as the frequency increases.

Figure 3B:
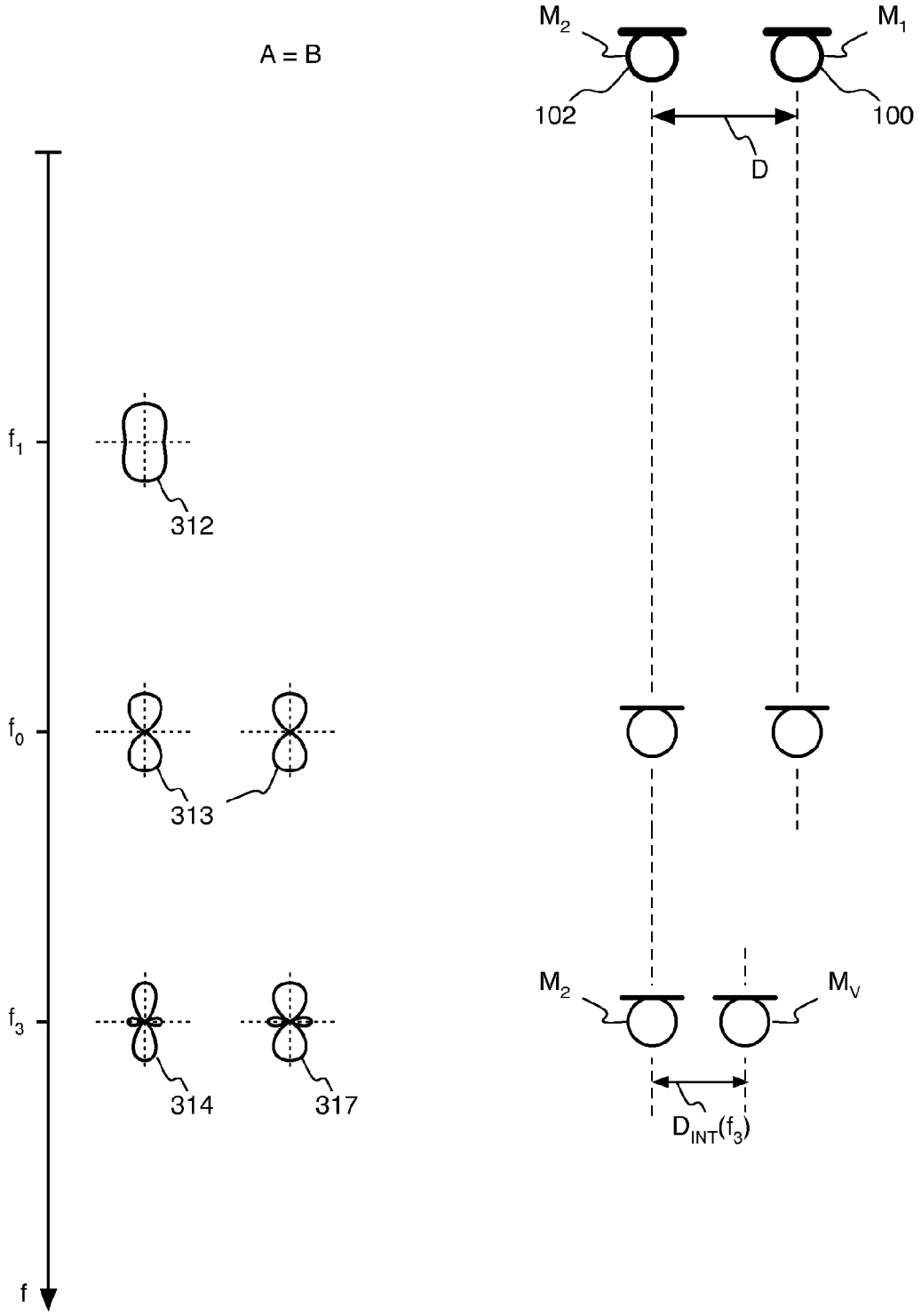

The interpolation will now be described with reference to FIG. 3*b*. For simplicity's sake let it be assumed that A=B=1. This means that in the signal processing arrangement 105 in FIG. 1 the multiplication factor in the multiplication circuit 111 is $g^{1/2}$ and the multiplication factor in the multiplication circuit 110 is $(1-g)^{1/2}$. For an interpolation, the distance between the virtual microphone $M_v$ and microphone 102 is smaller than D, and thus the frequency, at which the optimal directional characteristic occurs, is above $f_0$, e.g., at $f_3$, as indicated in FIG. 3*b* by the directional characteristic 317. Due to the frequency dependency of g[f], as indicated in FIG. 2*b*, this means that this optimal directional characteristic is now largely maintained in a frequency range above $f_0$, as indicated by the frequency characteristics 313 and 317 in FIG. 3*b*.

It should be mentioned that in the above description the correlation between $D_{INT}$, depending on the frequency, and g[f] is as follows:

$$D_{INT}(f)/D\approx 1-g[f] \text{ for } f\gtrsim f_0$$

Further, $$f_0/f\approx D_{INT}(f)/D$$

applies.

Therefore, due to the microphone arrangement according to FIG. 1, an enlargement of the frequency range for which the optimal directional characteristic is maintained, is possible only towards low frequencies, or only towards higher frequencies, depending upon the values for A and B. In the first case A=−B, and preferably: A=1 and B=−1. In the second case A=B, and preferably A=B=1.

Figure 2C:
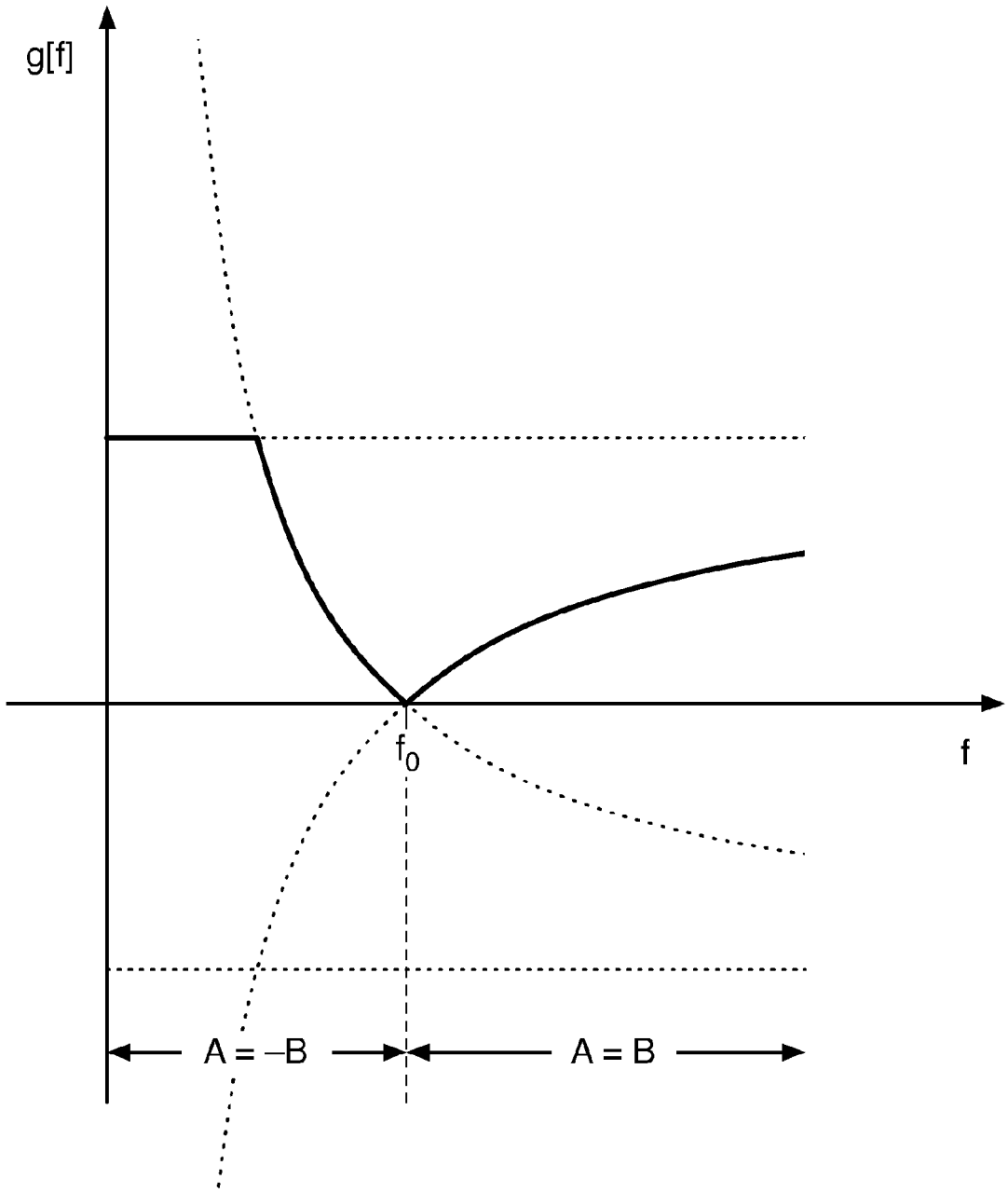

FIG. 2*c* shows a behaviour of the multiplication factor g[f] as a function of f, which for frequencies below $f_0$ is equal to the behaviour of the multiplication factor in FIG. 2*a*, and for frequencies above $f_0$ is equal to the behaviour of the multiplication factor in FIG. 2*b*. In this way the extrapolations and interpolations are combined which means that the microphone arrangement in FIG. 1 has a directional characteristic which in a frequency range between $f_1$ and $f_3$ has a largely optimal directional characteristic, as indicated by 313, 316 and 317 in FIGS. 3*a* and 3*b*.

Figure 4:
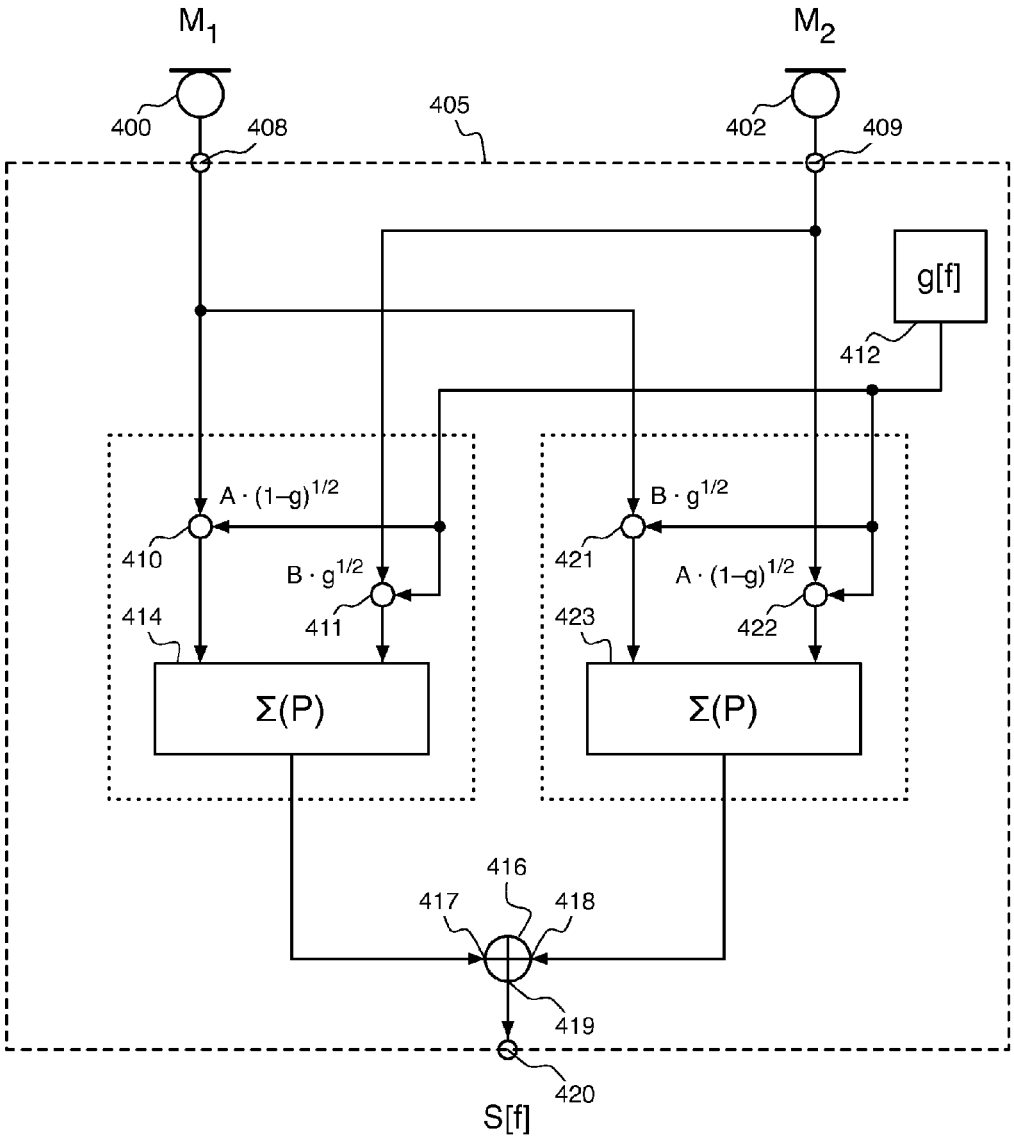

FIG. 4 shows a second exemplary embodiment of the microphone arrangement according to the invention.

The microphone arrangement according to FIG. 4 shows great similarities with the microphone arrangement of FIG. 1. The circuit parts in the signal processing arrangement 405, which in FIG. 4 are designated 410, 411, 412, 414, and 416, are similar to the circuit parts 110, 111, 112, 114, 116 of the signal processing arrangement 105 in FIG. 1. The signal processing arrangement 405 in FIG. 4 is further provided with a third and a fourth multiplication circuit 421, 422. The third and fourth multiplication circuits 421 and 422 are provided with signal inputs coupled with the first or the second input 408 or 409 of the signal processing arrangement 405, with control inputs for receiving respective first or second control signals, and with signal outputs.

An arrangement 423 for power-corrected summation is provided with a first and a second input coupled with the output of the third or fourth multiplication circuit 421, 422, and an output. The arrangement 423 is configured for power-corrected summation of the signals offered at its first and second inputs and for providing a power-corrected summed overall signal at the output which is coupled with the second input 418 of the signal combining arrangement 416.

The third multiplication circuit 421 is configured for multiplying the signal at its input with a multiplication factor $B \cdot g^{1/2}$, under the influence of the second control signal. The fourth multiplication circuit 422 is configured for multiplying the signal at its input with a multiplication factor $A \cdot (1-g)^{1/2}$ under the influence of the first control signal. Both control signals are generated by the control signal generator 412. Exactly as already mentioned with reference to FIG. 1, g is frequency-dependent according to the invention and A and B are constant values, the absolute values of which are preferably equal 1. Further, A=B or A=−B applies.

The arrangement 423 is preferably identical with the arrangement 414.

Figure 5A:
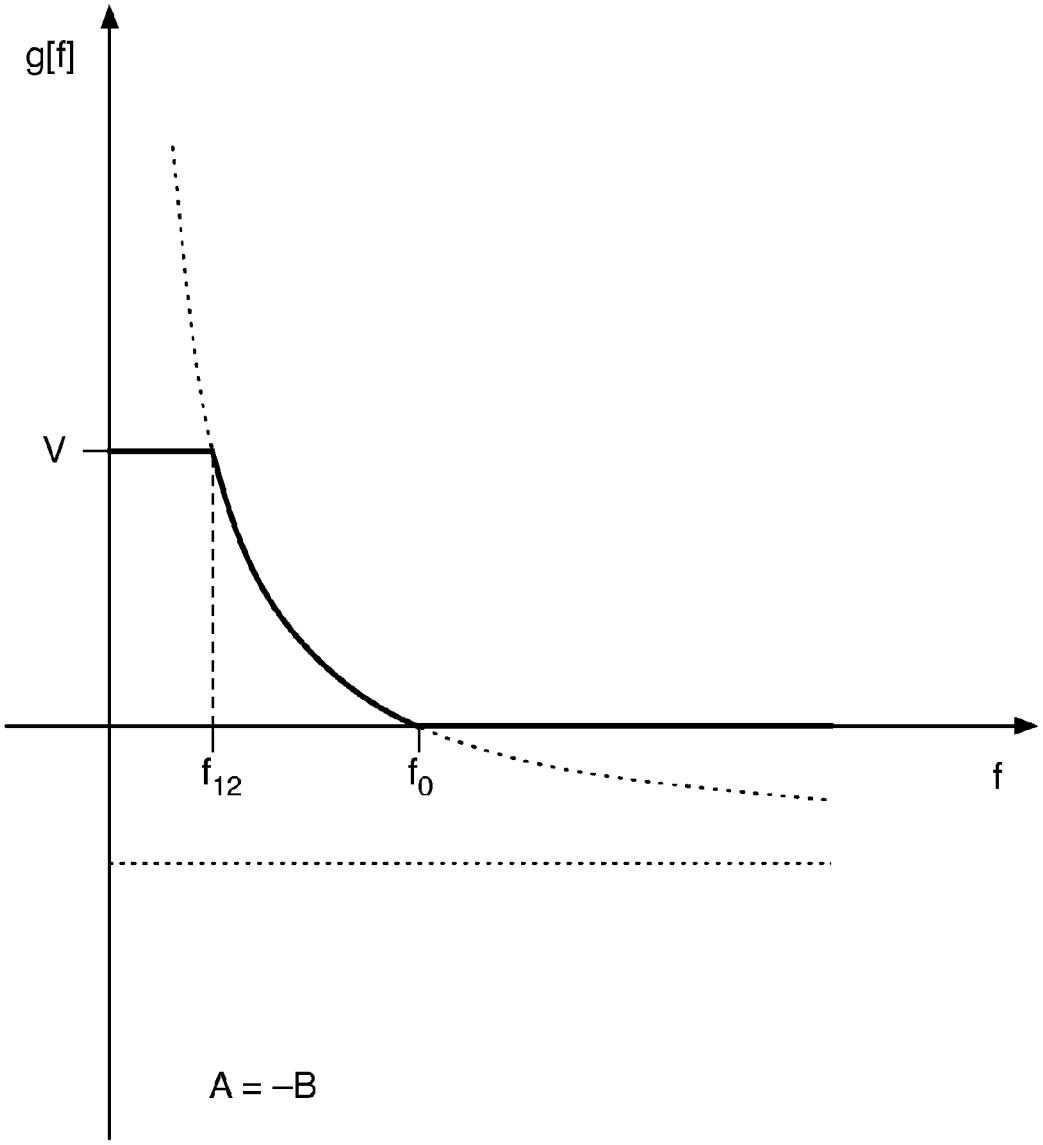

FIG. 5*a* shows what the frequency-dependent behaviour of the multiplication factor g[f] could look like. In this case A=−B.

The multiplication factor g[f] in FIG. 5*a* shows a frequency value which decreases for an increasing frequency between a first frequency value $f_0$ and a second frequency value $f_{12}$. Below the frequency value $f_{12}$, g[f] is a constant value V, preferably equal 1. Above the first frequency value $f_0$, g[f] is again constant, preferably equal zero. In the frequency range between $f_{12}$ and $f_0$, g[f] continuously decreases as the frequency increases.

Figure 6A:
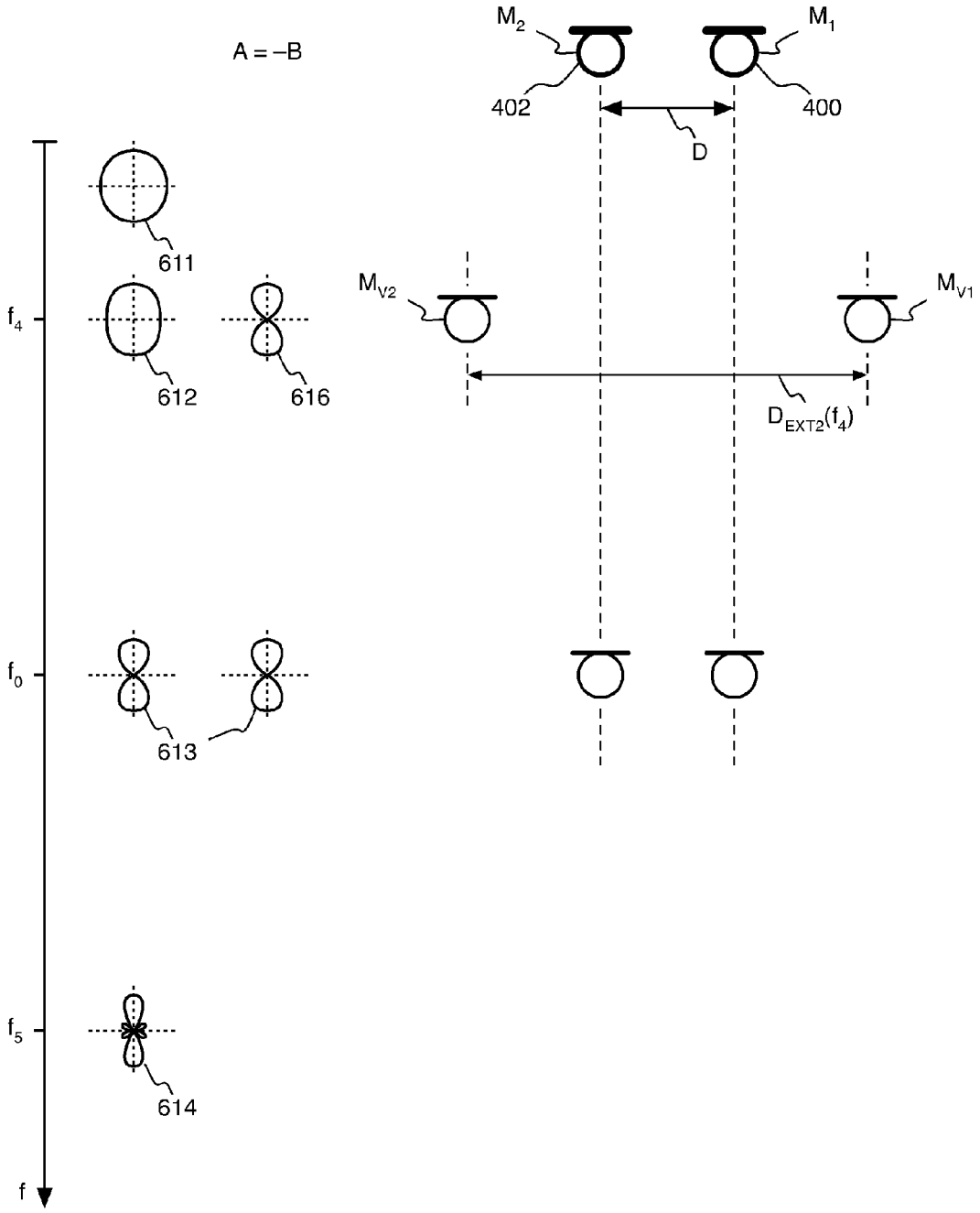

The mode of operation of the microphone arrangement of FIG. 4 with a behaviour for g[f] as shown in FIG. 5*a* will now be explained in detail with reference to FIG. 6*a*. FIG. 6*a* shows the directional characteristics of a microphone arrangement with two microphones, as shown in FIG. 4, which are arranged at a distance D from each other and the output signals of which are directly added together.

For low frequencies, the directional characteristic as indicated with 611, is again spherical. For increasing frequencies, the directional characteristic changes as has already been described with reference to FIG. 3*a* and as indicated by the directional characteristics 612, 613 and 614. The directional characteristic 613 is again assumed as being the desired directional characteristic, for the same reasons as already explained in conjunction with FIG. 3*a*. The frequency $f_0$, at which the optimal directional characteristic occurs, is given by $$f_0 = C/(2 \cdot D)$$

wherein C is the speed of sound.

It is the object of the invention to keep the optimal directional characteristic 613 largely constant for an increased frequency range. This is achieved as follows. Signal processing in the circuit parts 410, 411 and 414 leads, as already explained with reference to FIGS. 3*a* and 3*b*, to a virtual microphone signal of a virtual microphone at the output of the arrangement 414, which microphone is situated either between the two microphones 408 and 409 (whereby an interpolation of the microphone signals is performed by the circuit parts 410, 411 and 414) or which is situated outside the two microphones 408 and 409 (whereby an extrapolation of the microphone signals is performed by the circuits parts 410, 411 and 414).

Exactly the same applies, of course, to the signal processing in the circuit parts 421, 422 and 423. This means that a microphone signal of a virtual microphone is also generated at the output of the arrangement 423.

An extrapolation in the microphone arrangement of FIG. 4 is achieved for the case A=−B. A, for example, could be equal to 1. At the output of the arrangement 414 a microphone signal of a virtual microphone $M_{v1}$ is then present, and at the output of the arrangement 423 the microphone signal of a virtual microphone $M_{v2}$ is then present. The positions of both virtual microphones are shown in FIG. 6*a*. Extrapolation in this case means that the distance $D_{EXT2}$ between the two virtual microphones $M_{V1}$ and $M_{V2}$ is not only larger than D but also larger than $D_{EXT}$ in FIG. 3*a*.

Thus, the frequency range at which the desired directional characteristic is largely maintained, may be enlarged towards even lower frequencies, i.e., in a frequency range between $f_0$ and $f_{12}$, in FIG. 6*a*. Since g[f] is constant above $f_0$, preferably equal to zero, the directional characteristic of the microphone arrangement for frequencies above $f_0$ remains unchanged.

For $f<f_{12}$, g cannot increase beyond the value 1 for decreasing frequencies because g=1 is the maximum possible value for which $(1-g)^{1/2}$ can be calculated.

It should be mentioned that in the above description the correlation between $D_{EXT}$, dependent on the frequency, and g[f] is as follows:

$$D_{EXT}(f)/D \approx \tfrac{1}{2} + g[f] \text{ for } f_{12} < f < f_0$$

Further, $$f_0/f \approx D_{EXT}(f)/D$$

applies.

Figure 5B:
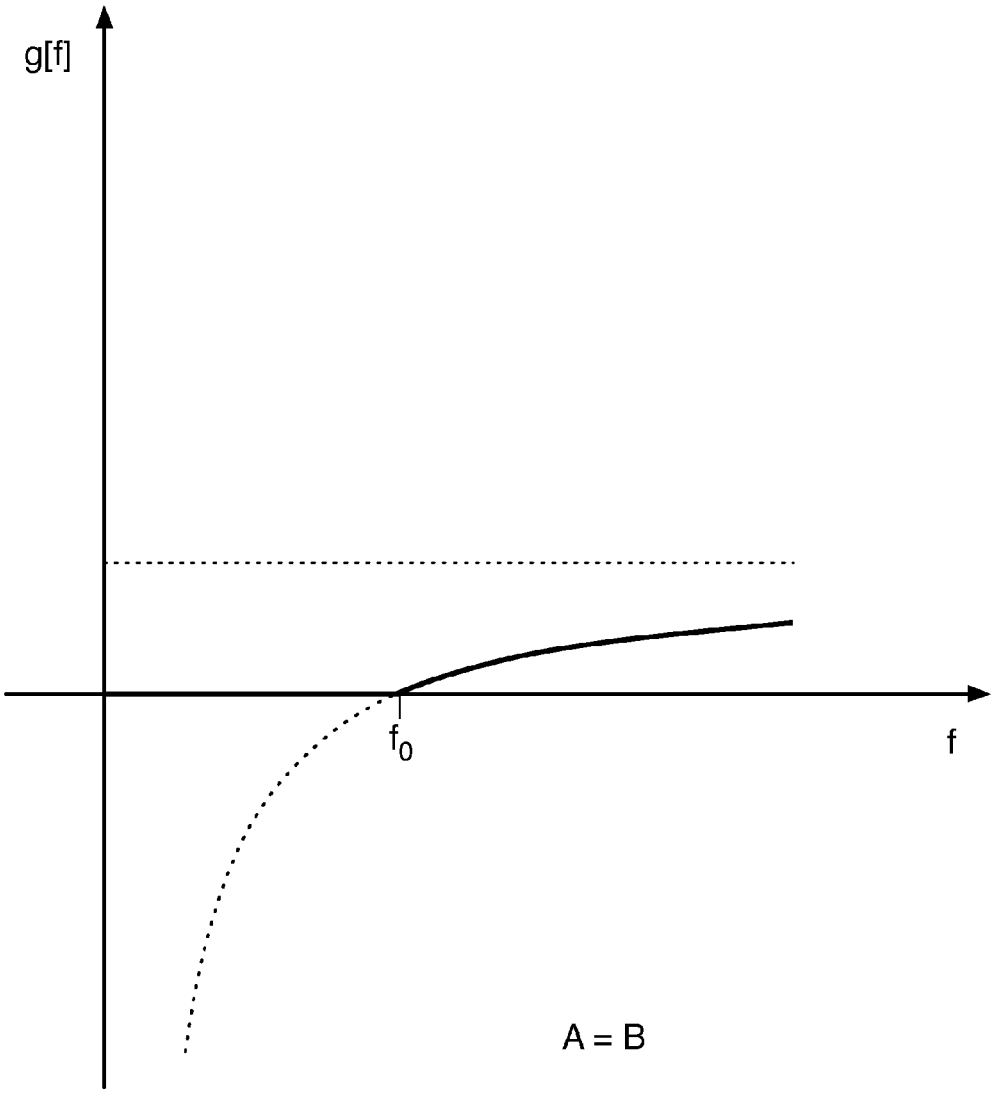
Figure 5C:
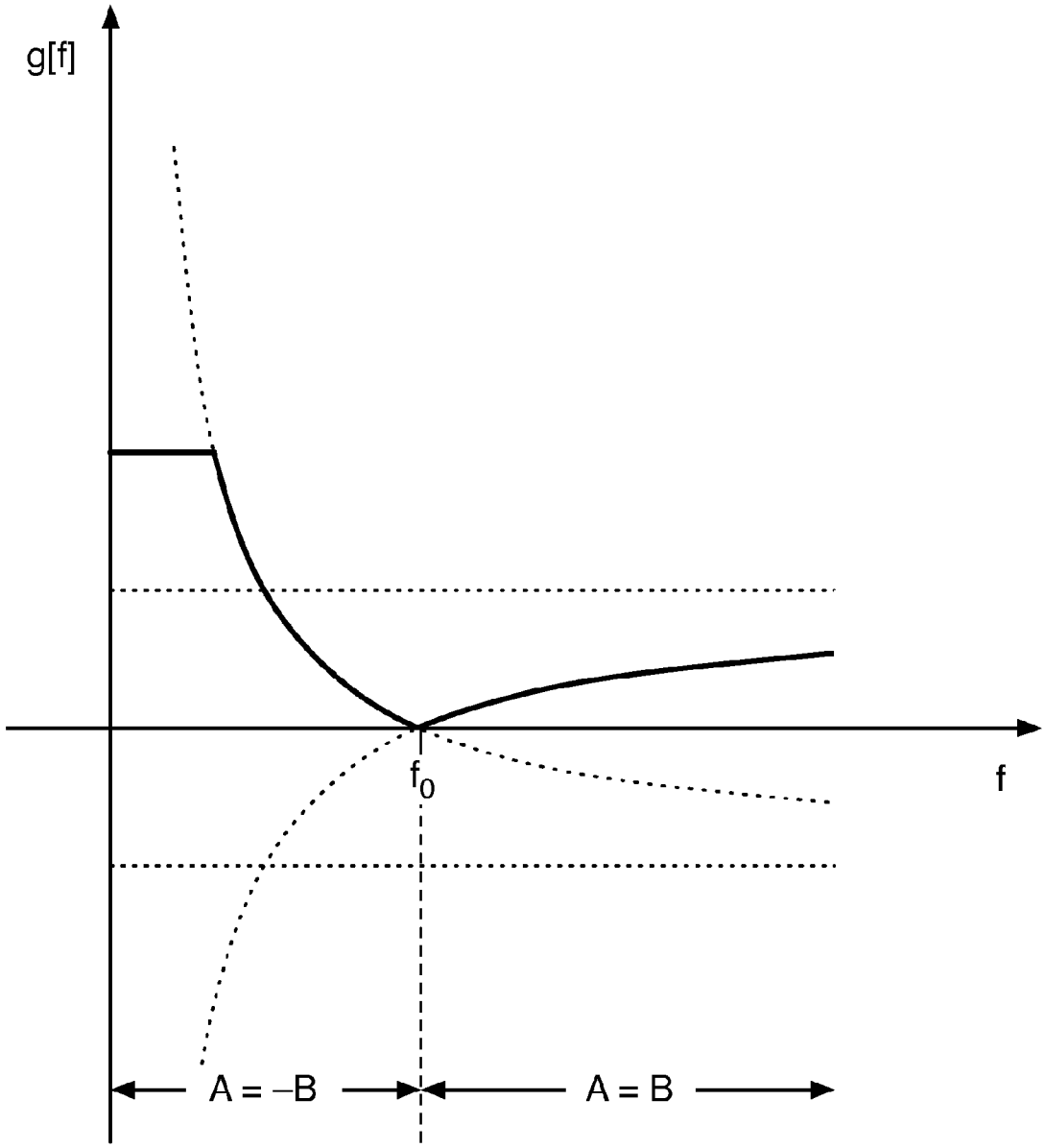

An interpolation in the microphone arrangement of FIG. 4 is achieved for the case A=B, wherein the multiplication factor g[f] behaves as a function of the frequency as indicated in FIG. 5*b*. For frequencies below $f_0$, g[f] is equal to a constant, preferably equal zero. For frequencies above $f_0$ the multiplication factor g[f] increases in value as the frequency increases. Preferably the multiplication factor g[f] above $f_0$ continuously increases in value as the frequency increases.

The interpolation will now be described with reference to FIG. 6*b*. For simplicity's sake it is assumed that A=B=1.

The microphone signal of a virtual microphone $M_{v1}$ is then present at the output of the arrangement 414, and the microphone signal of a virtual microphone $M_{v2}$ is then present at the output of the arrangement 423. The positions of both virtual microphones are shown in FIG. 6*b*. The interpolation means in this case that the distance $D_{INT2}$ between the two virtual microphones $M_{v1}$ and $M_{v2}$ is not only smaller than D, but also smaller than $D_{INT}$ in FIG. 3*b*.

Figure 6B:
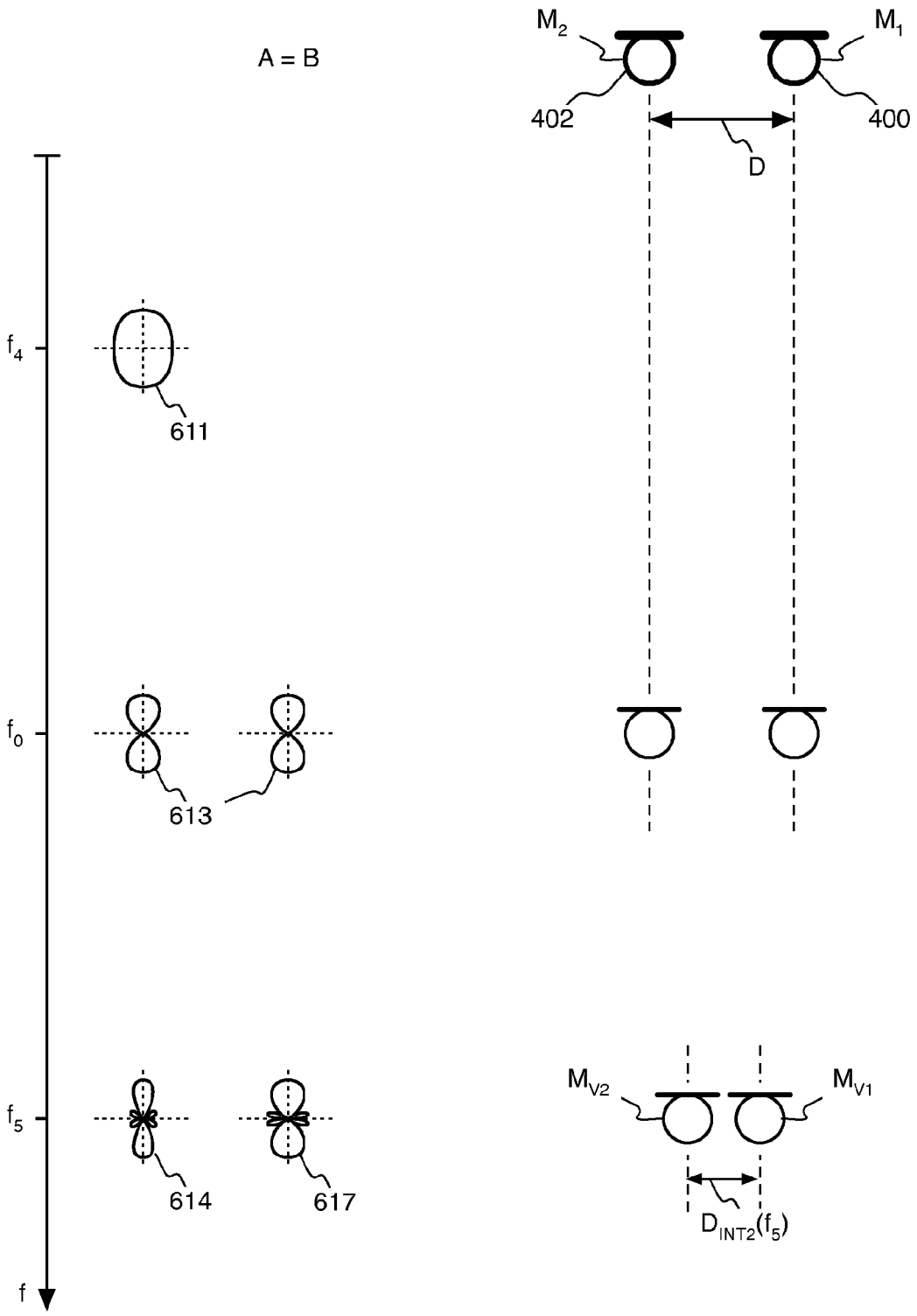

Thus the frequency range, at which the desired directional characteristic is largely maintained, can be enlarged towards higher frequencies, i.e., in the frequency range above $f_0$ in FIG. 6*b*. Since g[f] remains constant, preferably equaling zero for frequencies below $f_0$, the directional characteristic of the microphone arrangement for frequencies below $f_0$ remains unchanged.

It should be mentioned that in the above description the correlation between $D_{INT}$, dependent on the frequency, and g[f] is as follows:

$$D_{INT}(f)/D \approx \tfrac{1}{2} - g[f] \text{ for } f \gtrsim f_0$$

Further, $$f_0/f \approx D_{INT}(f)/D$$

applies.

FIG. 6*c* shows a behaviour of the multiplication factor g[f] as a function of f, which for frequencies below $f_{10}$ is equal to the behaviour of the multiplication factor in FIG. 6*a* and for frequencies above $f_{10}$ is equal to the behaviour of the multiplication factor in FIG. 6*b*. In this way, the extrapolation and the interpolation are combined, which means that the microphone arrangement in FIG. 4 has a directional characteristic which in a frequency range between $f_4$ (see FIG. 6*a*) and $f_5$ (see FIG. 6*b*) has a largely optimal directional characteristic, as indicated by 613, 616 and 617 in FIGS. 6*a* and 6*b*.

Additionally, it should be mentioned that the rising and falling parts of the progression of the multiplication factor g[f] as a function of the frequency as shown in FIGS. 2*a*, 2*b*, 2*c*, 5*a*, 5*b* and 5*c*, behave like parts of a hyperbolic curve. This follows from the inverse proportionality to the frequency in the above-mentioned formulae.

Figure 7:
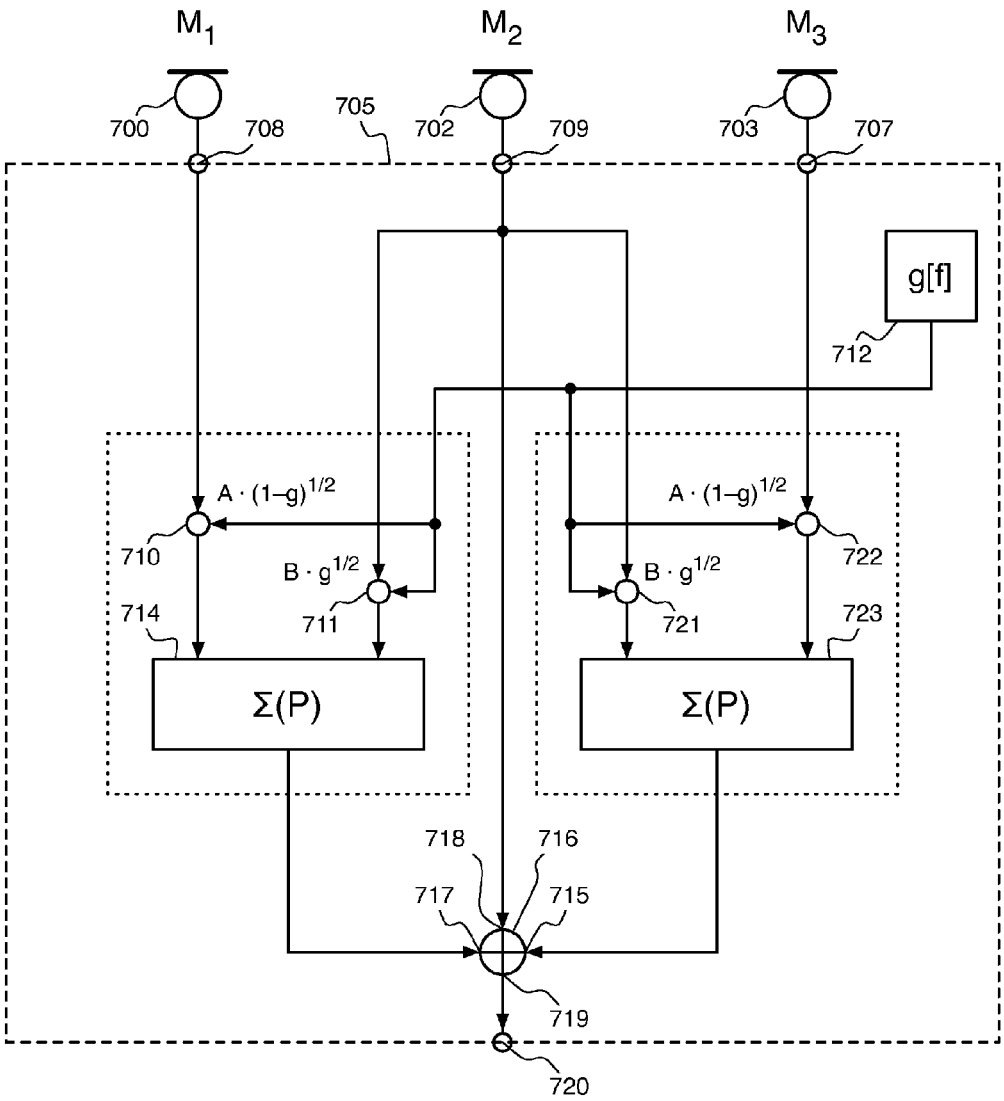

FIG. 7 shows a third exemplary embodiment of the microphone arrangement according to the invention. In this case the microphone arrangement comprises three microphones 700, 702 and 703. The signal processing arrangement 705 is now constructed as follows: The circuit parts in the signal processing arrangement 705 indicated in FIG. 7 by 710, 711, 712, 714, and 716, are similar to the circuit parts 110 and 111 and 112 and 114 and 116 of the signal processing arrangement 105 in FIG. 1, respectively. The third microphone 403 is coupled with a third input 707 of the signal processing arrangement 705. The signal processing arrangement 705 is further provided with a third and a fourth multiplication circuit 721 and 722. The signal inputs of the multiplication circuits 721 and 722 are coupled with the second input 709 and the third input 707 of the signal processing arrangement 705, respectively. Control inputs of the multiplication circuits 721 and 722 are coupled with the control signal generator 712 for receiving respective first and second control signals, respectively. Signal outputs of the two multiplication circuits 721 and 722 are coupled with associated inputs of an arrangement 723 for power-corrected summation. One output of the arrangement 723 is coupled with a third input 715 of the signal combining arrangement 716. The arrangement 723 is configured for power-corrected summation of the signals offered at its first and second inputs and for providing a power-corrected summed overall signal at the output. The third multiplication circuit 721 is configured for multiplying the signal at its input with a multiplication factor $B \times g^{1/2}$ under the influence of the second control signal. The fourth multiplication circuit 722 is configured for multiplying the signal at its input with a multiplication factor $A \times (1-g)^{1/2}$ under the influence of the first control signal.

Both control signals are generated by the control signal generator 712. Just as already indicated with reference to FIG. 1 according the invention the multiplication factor g is frequency-dependent, and A and B are constant values the absolute values of which are preferably equal 1. Further: A=B or A=−B. The frequency-dependent behaviour of the multiplication factor g[f] in the embodiment of FIG. 7 is again as already described with reference to FIGS. 2*a* to 2*c*.

The arrangement 723 is preferably identical with the arrangement 714.

Figure 8:
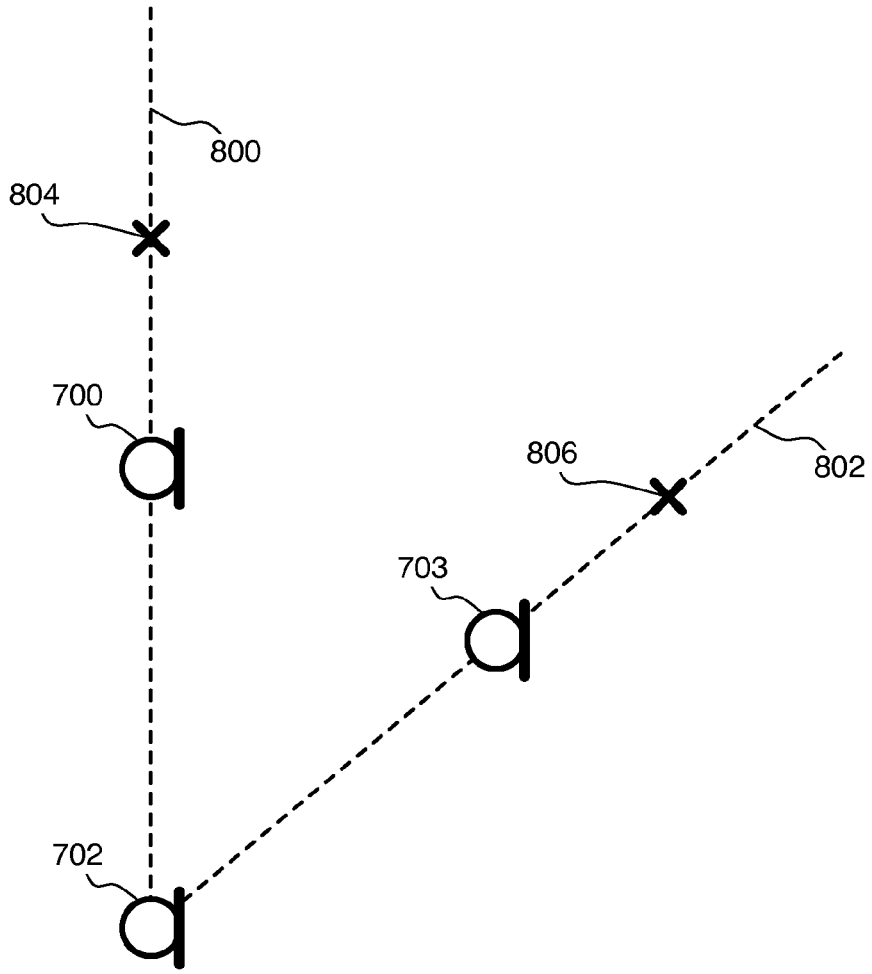

The three microphones 700, 702 and 703 need not necessarily lie on a straight line. FIG. 8 shows the position of the three microphones 700, 702 and 703, which in this case are positioned on intersecting lines. In the embodiment of FIG. 7 two virtual microphone signals are again generated. The first virtual microphone signal is present at the input 717 of the signal combining arrangement 716 and is derived from the microphone signals of the microphones 700 and 702. The second virtual microphone signal is present at the input 715 of the signal combining arrangement 716 and is derived from the microphone signals of microphones 702 and 703.

Let it be assumed that in the microphone arrangement of FIG. 7 an extrapolation is performed for obtaining the two virtual microphone signals. This has the effect as if two virtual microphones had been realised. Specifically speaking, as if the microphone 700 were no longer at the position indicated in FIG. 8, but further away from the microphone 702 on the connection line 800 through the two microphones 700 and 702, e.g., at the position 804. Similarly it seems as if the microphone 703 is not at the indicated position, but further away from the microphone 702 on the connection line 802 through the two microphones 702 and 703, e.g., at the position 806. The position of the microphone 702 does not change. Due to this other position for the two virtual microphone signals another directional characteristic of the microphone arrangement, of course, is created which can now be modified as desired.

Figure 9:
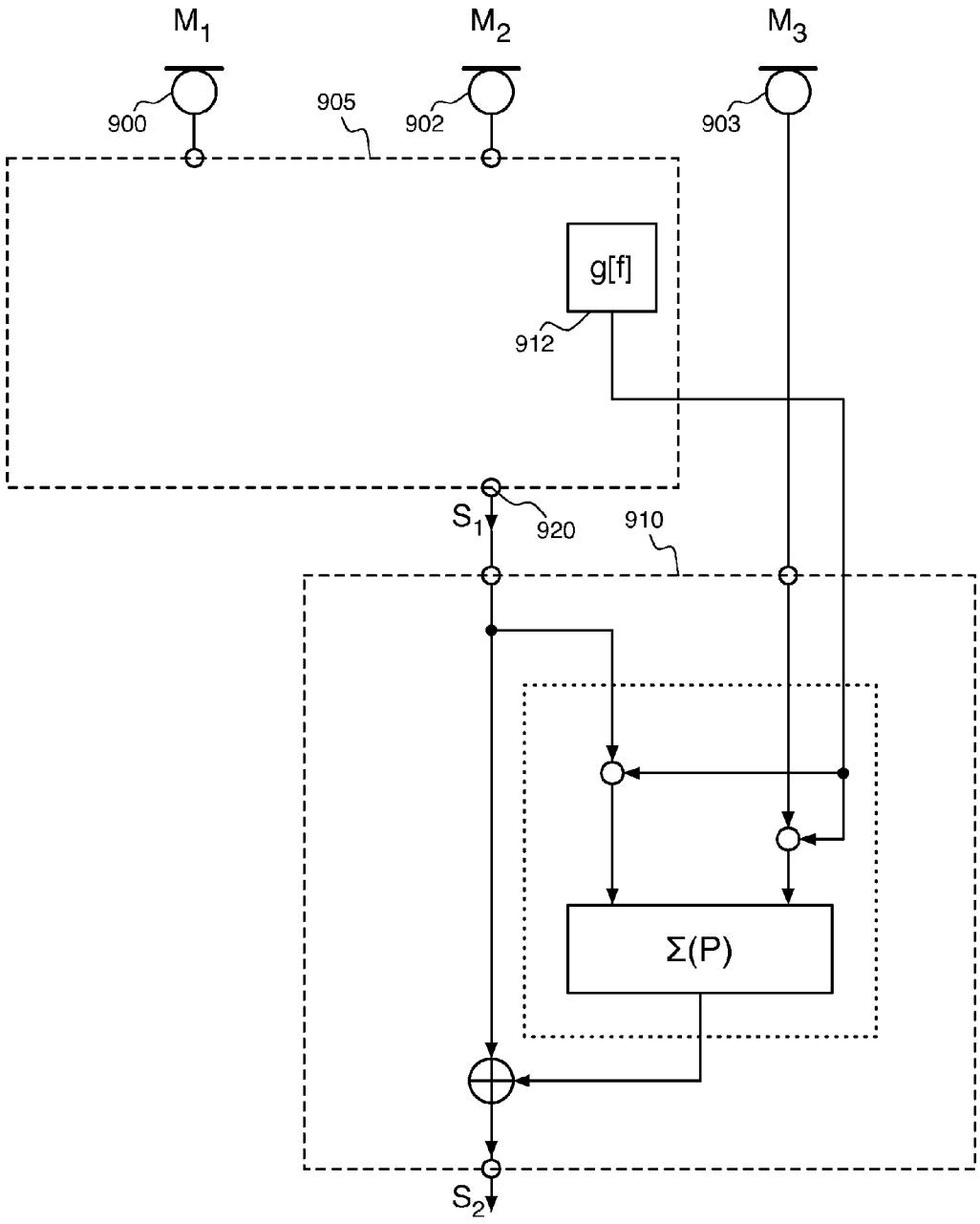

Yet another embodiment of a microphone arrangement with three microphones is shown in FIG. 9. The microphone signals of two microphones 900 and 902 are processed in the circuit part 905 which can be constructed as shown in FIG. 1 or 4, in order to obtain an output signal $S_1$ at the output 920. The output signal $S_1$ and the microphone signal of the microphone 903 are then brought together in a circuit part 910 in order to obtain the output signal $S_2$ of the microphone arrangement. The circuit part 910 may again look like the circuit part 105 shown in FIG. 1 (and as can indeed be seen in FIG. 9) or like the circuit part 405 shown in FIG. 4.

Figure 10:
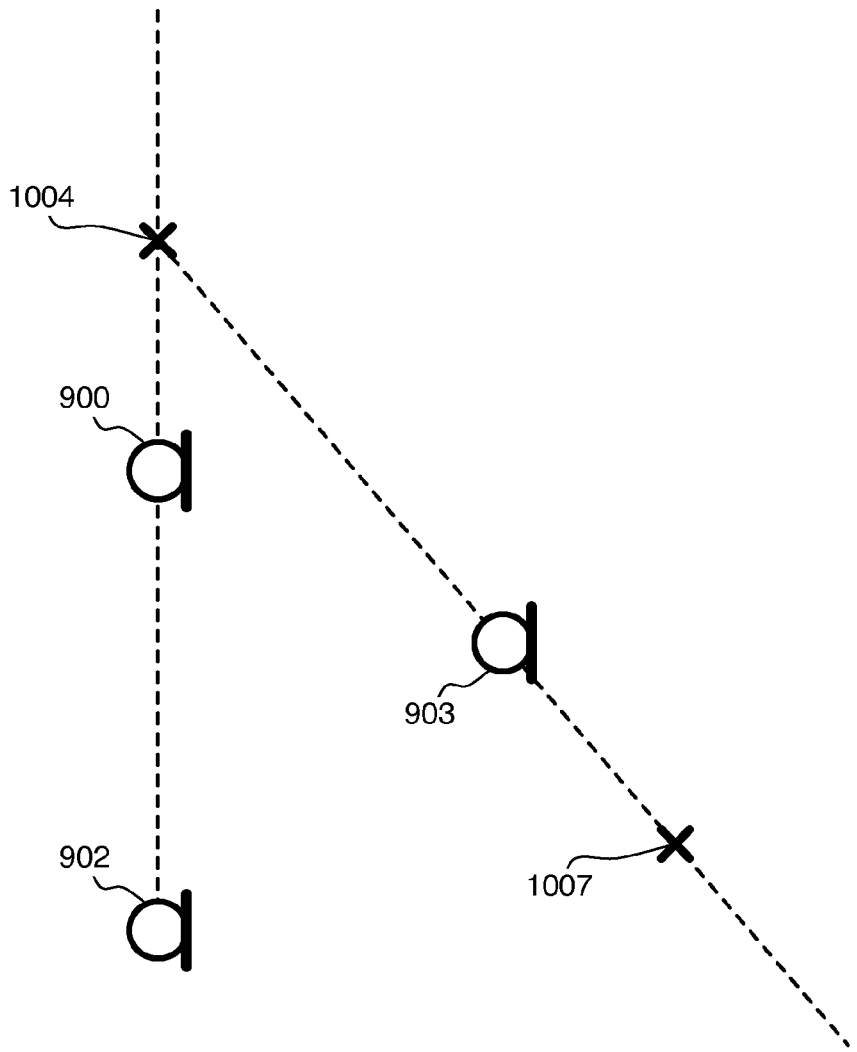

The positions of the virtual microphones arise as shown in FIG. 10. In this case, a first extrapolation is now performed on the microphone signals of the microphones 900 and 902, whereby a virtual microphone signal $S_1$ of a first virtual microphone at the position 1004 is derived at the output 920 in FIG. 9. Thereafter a second extrapolation is performed on the microphone signals of the first virtual microphone at the position 1004 and the microphone 903, which leads to a second virtual microphone signal of a virtual microphone at the position 1007, whereby the second virtual microphone signal is present on the line 930 in FIG. 9. The output signal $S_2$ at the output of the microphone arrangement is therefore the combination of the two first and second virtual microphone signals.

In conclusion, it should be mentioned that the invention is not limited to the exemplary embodiments shown in the description of the figures. As such various modifications are possible which however, all fall within the scope of the invention. As such the microphone arrangement may be comprised of more than three microphones. The microphones need not necessarily lie on a straight line.

The invention claimed is:

1. A microphone arrangement provided with at least two microphones and a signal processing arrangement for deriving a virtual microphone signal from the microphone signals of the at least two microphones, wherein the signal processing arrangement is provided with a first and a second input for receiving the microphone signals of the at least two microphones, a first and a second multiplication circuit, with signal inputs coupled with the first and second input of the signal processing arrangement, respectively, with control inputs for receiving respective first and second control signals, respectively, and with signal outputs, a control signal generator for generating the first and second control signals, an arrangement for power-corrected summation, with a first and a second input coupled with the output of the first and second multiplication circuit, respectively, and an output, wherein the arrangement is configured for power-corrected summation of the signals offered at its first and second inputs and for providing a power-corrected summed overall signal at the output, a signal combining arrangement, with a first input coupled with the output of the power-corrected summation arrangement, a second input coupled with one of the at least two microphones and an output coupled with the output of the signal processing arrangement, wherein the first multiplication circuit is configured for multiplying the signals at its input with a multiplication factor $A\cdot(1-g)^{1/2}$ under the influence of the first control signal, the second multiplication circuit is configured for multiplying the signal at its input with a multiplication factor $B\cdot g^{1/2}$ under the influence of the second control signal, wherein g is frequency-dependent (g[f]), in that A and B are constant values, the absolute values of which preferably being equal 1, and further A=B or A=−B applies.

2. The microphone arrangement according to claim 1, wherein the multiplication factor g[f], below a first frequency value, has a smaller value as the frequency increases.

3. The microphone arrangement according to claim 2, wherein the multiplication factor g[f], below the first frequency value, continuously decreases in value as the frequency increases.

4. The microphone arrangement according to claim 2, wherein the multiplication factor g[k], below a second frequency value that is smaller than the first frequency value, has a constant value (V).

5. The microphone arrangement according to claim 4, wherein the constant value (V) is equal to 1.

6. The microphone arrangement according to claim 2, wherein the multiplication factor g[k], above the first frequency value, has a constant value equal to zero.

7. The microphone arrangement according to claim 1, wherein A=−B.

8. The microphone arrangement according to claim 1, wherein the multiplication factor g[k], above the first frequency value, has a larger value as the frequency increases.

9. The microphone arrangement according to claim 8, wherein the multiplication factor g[k], above the first frequency value, continuously increases in value as the frequency increases.

10. The microphone arrangement according to claim 8, wherein the multiplication factor g[k], below the first frequency value, has a constant value equal to zero.

11. The microphone arrangement according to claim 8, wherein A=B.

12. The microphone arrangement according to claim 2, wherein A=−B for frequency values below the first frequency value, and A=B for frequency values above the first frequency value.

13. The microphone arrangement according to claim 2, wherein the rising or falling parts of the progression of the multiplication factor g[f] as a function of the frequency show a hyperbolic curve behaviour.

14. The microphone arrangement according to claim 1, wherein the signal processing arrangement is further provided with a third and a fourth multiplication circuit, with signal inputs, coupled with the first and second input of the signal processing arrangement, respectively, with control inputs for receiving respective first and second control signals, respectively, and with signal outputs, an arrangement for power-corrected summation, with a first and a second input coupled with the output of the third and fourth multiplication circuit, respectively, and with an output, wherein the arrangement is configured for power-corrected summation of the signals offered at its first and second inputs and for providing a power-corrected summed overall signal at the output, wherein the output is coupled with the second input of the signal combining arrangement.

15. The microphone arrangement according to claim 14, wherein the third multiplication circuit is configured for multiplying the signal at its input with a multiplication factor $B\cdot g^{1/2}$ under the influence of the second control signal, and the fourth multiplication circuit is configured for multiplying the signal at its input with a multiplication factor $A\cdot(1-g)^{1/2}$ under the influence of the first control signal.

16. The microphone arrangement according to claim 1, provided with three microphones, wherein the third microphone is coupled with a third input of the signal processing arrangement, the signal processing arrangement being further provided with a third and a fourth multiplication circuit, with signal inputs coupled with the second and third input of the signal processing arrangement, respectively, with control inputs for receiving respective first and second control signals, and with signal outputs, an arrangement for power-corrected summation, with a first and a second input coupled with the output of the third and fourth multiplication circuit, respectively, and an output, wherein the arrangement is configured for power-corrected summation of the signals offered at its first and second inputs and for providing a power-corrected summed overall signal at the output, wherein the output is coupled with a third input of the signal combining arrangement.

17. The microphone arrangement according to claim 16, wherein the third multiplication circuit is configured for multiplying the signal at its input with a multiplication factor $B\times g^{1/2}$ under the influence of the second control signal, and the fourth multiplication circuit is configured for multiplying the signal at its input with a multiplication factor $A\times(1-g)^{1/2}$ under the influence of the first control signal.

18. A signal processing arrangement for deriving a combination signal (S[f]) from the microphone signals of at least two microphones characterised by wherein the part features of the signal processing arrangement as defined in claim 1.

* * * * *